US006868845B1

(12) United States Patent
Moore

(10) Patent No.: US 6,868,845 B1
(45) Date of Patent: Mar. 22, 2005

(54) AUTOMATIC LOADING CROSS-BOW

(76) Inventor: Ralph J. Moore, 12227 Lynda Dr., Houston, TX (US) 77038

( * ) Notice: Subject to any disclaimer, the term of this patent is extended or adjusted under 35 U.S.C. 154(b) by 0 days.

(21) Appl. No.: 10/704,100

(22) Filed: Nov. 7, 2003

(51) Int. Cl.[7] ..... F41B 5/12
(52) U.S. Cl. ..... 124/25
(58) Field of Search ..... 124/25

(56) References Cited

U.S. PATENT DOCUMENTS 3,739,765 A * 6/1973 Moore ..... 124/25
3,968,783 A * 7/1976 Pfotenhauer ..... 124/25
4,722,318 A * 2/1988 Yankey ..... 124/25
4,827,894 A * 5/1989 Schallberger ..... 124/25
4,877,008 A * 10/1989 Troubridge ..... 124/25
5,119,797 A * 6/1992 Anderson ..... 124/25
5,243,956 A * 9/1993 Luehring ..... 124/86
5,544,641 A * 8/1996 Jenn ..... 124/25
5,596,976 A * 1/1997 Waiser ..... 124/25
5,598,829 A * 2/1997 Bednar ..... 124/25

* cited by examiner

*Primary Examiner*—John A. Ricci
(74) *Attorney, Agent, or Firm*—The Matthews Firm

(57) ABSTRACT

An improved automatic loading cross-bow comprising a main frame having pivotally mounted interchangeable bow limbs adjacent to its front end. The bow limbs can be latched in a folding position, for easy transportation, in an extended position for firing, or can be interchanged for different bow weights. The cross-bow includes an arrow magazine containing a plurality of arrows adapted to be attached to the main frame. An improved spring device automatically feeds arrows, one at a time, into the firing position in the main frame as the bow string is cocked. An improved safety release trigger is adapted to be cocked by moving the bow string into firing position and to be fired only when the safety release and trigger are both actuated. The improved release trigger further provides for a smooth center line firing.

17 Claims, 8 Drawing Sheets

AUTOMATIC LOADING CROSS-BOW

BACKGROUND OF THE INVENTION

Field of the Invention

The present invention relates to a new and improved cross-bow construction and particularly to an automatic loading cross-bow having a clip or magazine for storing a plurality of arrows or projectiles, an improved internal guiding track for faster and more accurate firing, and an improved outer upper surface of the guiding track for slidably positioning various sights or scopes. The cross-bow of the present invention also includes an improved trigger mechanism and a safety release which preferably prevents unintentional or accidental discharge as well as providing a smooth and accurate intentional discharge.

DESCRIPTION OF EMBODIMENTS

Figure 1:
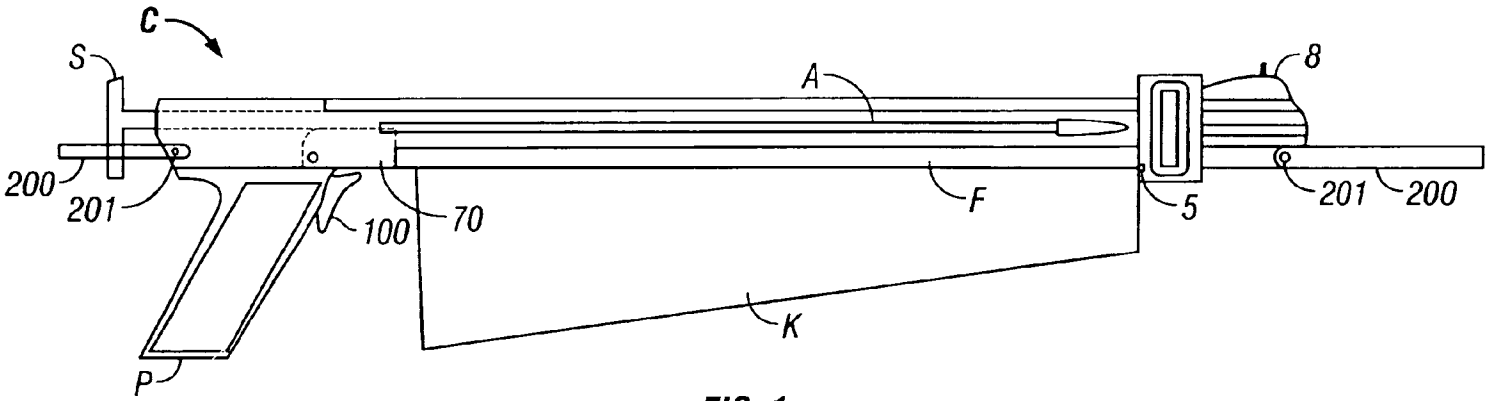
FIG. 1 is a side elevation partly in section and partly in phantom illustrating the improved automatic cross-bow apparatus with the arrow clip in position.
Figure 2:
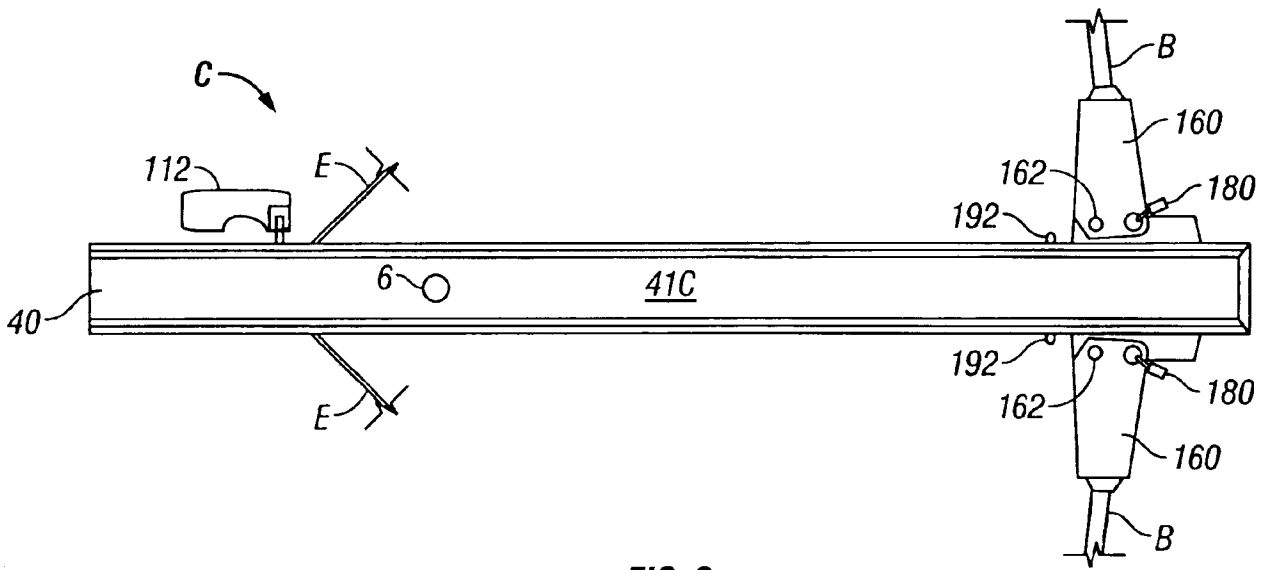
FIG. 2 is a top view of the cross-bow illustrating the upper guide and with the bow limbs in the extended position.

An exemplary type of cross-bow is shown in U.S. Pat. No. 3,739,765, issued Jun. 19, 1973, to Ralph J. Moore, which is incorporated herein by reference. As illustrated in FIGS. 1 and 2, an embodiment of the cross-bow C preferably comprises a main frame F having a pair of bow limbs B pivotally mounted on opposite sides of the main frame adjacent its front end and a shoulder piece or stock S retractably mounted adjacent the rear end of such main frame F. A pistol grip P is also affixed to the rear of the main frame on its lower side and preferably at least partially enveloping a firing mechanism 70, which is provided for holding the bow string E taut when the bow is cocked and for releasing such bow string to discharge an arrow A when the cross-bow is fired. It should be appreciated that the pistol grip can be covered or encased by rubber, plastic, wood, or any other material that is suitable to provide gripping ability as well as add utility or aesthetic value to the grip or the cross bow. An arrow clip K containing a plurality of arrows is releasably attached to the main frame F for automatically feeding an arrow into the main frame for firing each time the bow string E is drawn back and latched in the firing mechanism 70. It should be understood that the arrow clip K can also be called a magazine or otherwise described such as to convey the meaning of one of its functions; that of storing a plurality of arrows A. The plurality of arrows A, being stored in the clip K (FIG. 7), can be target arrows or hunting arrows or a combination of hunting and target arrows. It will be appreciated by those in the art that the clip K can accommodate a variety of hunting arrows including, but not limited to, those having two, three, or four blade arrowheads 17 disposed about the front of the arrow. It will also be appreciated that when utilizing the hunting arrows, the blades, of the arrowhead 17, will remain contained in the clip K or in the firing chamber of the cross bow thus reducing the risk of accidental cuts from the blades when transporting or handling the cross bow.

Figure 3:
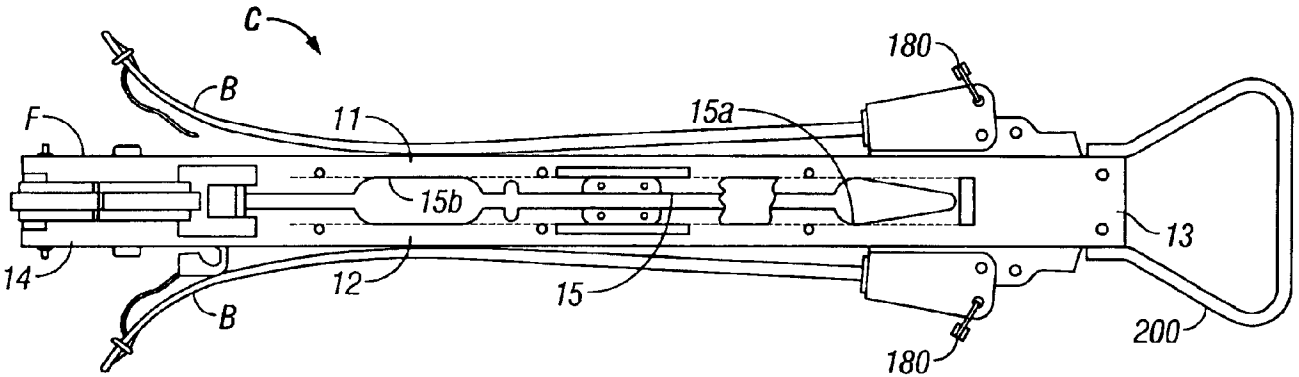
FIG. 3 is a bottom view of the cross-bow with the bow limbs folded back in a retracted position.

FIG. 3 illustrates the frame F as preferably comprising a pair of laterally spaced, longitudinally extending side rails 11, 12 which are disposed substantially parallel to each other and are preferably connected together at the front end by the front transverse member 13 and at the rear by the rear transverse member 14. Preferably a centrally disposed, longitudinally extending opening 15 is provided in the main frame F between the side rails 11, 12 to permit arrows A to be moved from the arrow clip K in to the firing position in the firing chamber in the main frame member F.

Figure 4:
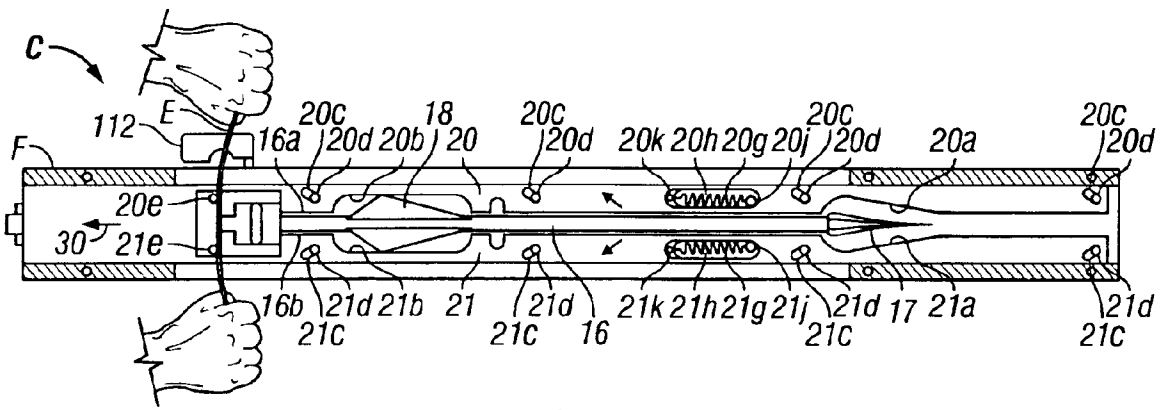
FIG. 4 is a sectional view illustrating an arrow in the firing position in the cross-bow and the bow string being drawn across the trigger mechanism.

As best seen in FIGS. 3 and 4, the central opening 15 includes a longitudinally extending slot for receiving the shaft or body 16 of the arrows A with an enlarged or relieved portion 15*a* for accommodating the arrowhead 17 disposed about the forward end of the shaft 16, and another enlarged or relieved portion 15*b* to accommodate the vane, feather or rear stabilizers 18 affixed adjacent the rear end of the arrow shaft 116. With the relieved portions 15*a*, 15*b* in the centrally disposed opening or passage 15, it will be appreciated that the arrows A may be moved vertically from a storage position in the clip K into position in the main frame F for firing with the longitudinal axis of the arrows A being maintained substantially parallel to the longitudinal axis of the main frame F.

A pair of longitudinally extending jaws or gate members 20, 21 are slidably mounted on top of the side rails 11, 12. The gate members 20, 21 are preferably coated with a TEFLON (tetrafluoroethylene fluorocarbon polymer—TEFLON is a registered trademark of DuPont du Nemours. E.I. & Co.), polyethylene, or similar resilient and substantially self lubricated element. This coating will preferably decrease the resistance or friction of the gate members against the arrow shaft 16 and feathers 18 when the apparatus is fired; thus preferably providing a faster and more accurate shot. The gate members can also be polished, coated, anodized, or otherwise treated to form a surface with limited frictional resistance when the arrow A is fired. Such slidable gate members 20, 21 preferably include forward relieved portions 20*a*, 21*a* for receiving the arrowhead 17 and rear relieved portions 20*b*, 21*b* for permitting the feather 18 to pass therethrough without damage when the arrows A are moved from storage in the clip K into the firing position above the jaws 20, 21.

The sliding jaws 20, 21 are provided with longitudinally spaced diagonal guides 20*c*, 21*c* which preferably extend inwardly and forwardly relative to the central opening 15. Guide pins or lugs 20*d*, 21*d* extend through the guide slots 20*c*, 21*c* and are affixed to the upper surface of the main frame F. Actuating pins 20*e*, 21*e* project upwardly at the rear end of the sliding jaws 20, 21 and, as illustrated in FIG. 4, are engaged by the bow string E when it is drawn back and latched in the firing mechanism 70. As illustrated, when the bow string E is moved rearwardly as indicated by the arrow 30 in FIG. 4, it engages the upstanding pins 20*e*, 21*e* and moves the sliding jaws 20, 21 rearwardly and also outwardly due the diagonally disposed guide slots 20*c*, 21*c* acting against the guide pins 20*d*, 21*d* to thereby spread the jaws 20, 21 laterally apart to allow the uppermost arrow A in the main frame F to be moved upwardly between the gates 20, 21 and into the firing position atop the gates 20, 21 as will be described in detail herein below.

Figure 5:
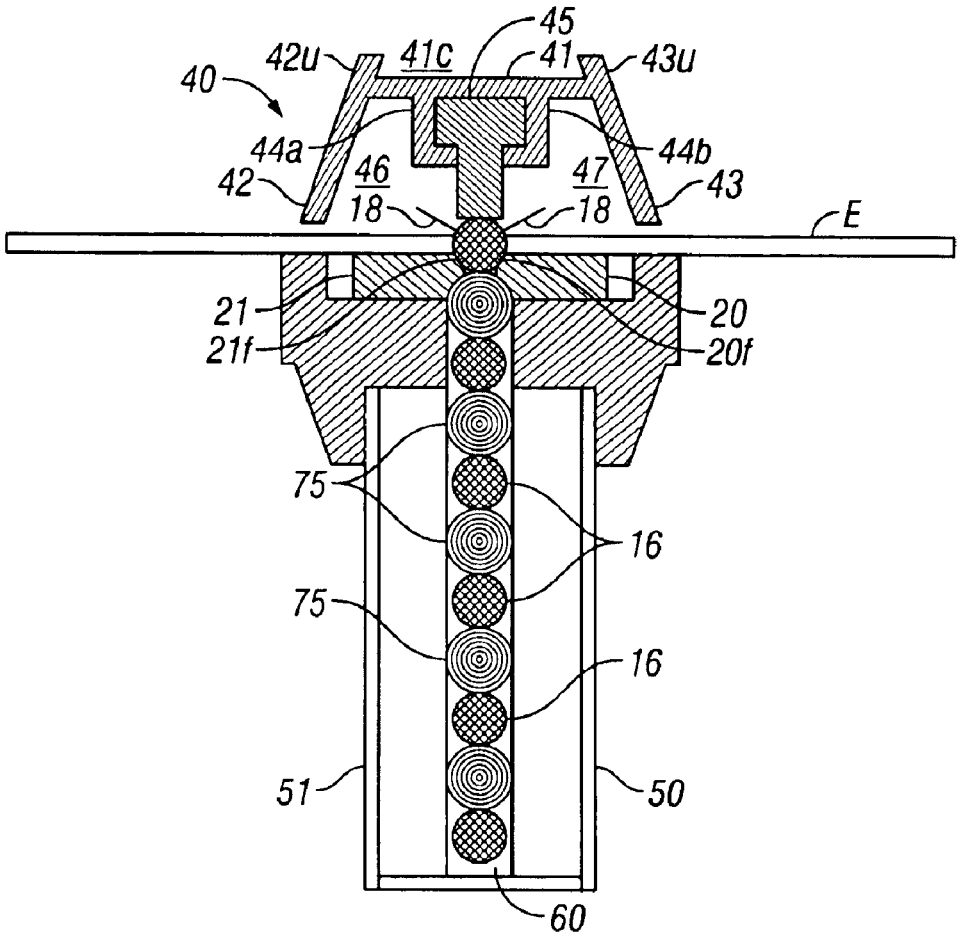
FIG. 5 is a sectional view illustrating the arrow feeding mechanism and a cross section of the upper guide and insert.

As illustrated in FIG. 5, the gates 20, 21 are provided with upwardly and outwardly rounded inner edges 20*f*, 21*f* which extend axially of the arrow shaft 16 for supporting and aligning the shaft 16 in position for firing. As illustrated in FIG. 4, each of the gates 20, 21 is preferably provided with a spring 20*g*, 21*g* which is preferably carried in the recesses 20*h*, 21*h* disposed in the gates 20, 21. The forward end of the springs 20*g*, 21*g* are connected to pins 20*j*, 21*j* mounted on the upper side of the main frame F and the rear end of the springs 20*g*, 21*g* are connected in suitable openings 20*k*, 21*k* in the gates 20, 21 adjacent the rear of the recesses 20*h*, 21*h*. The springs 20*g*, 21*g* move the gates 20, 21 from the open position when the bow string E is allowed to move forward against the latching member in the firing mechanism 70.

Referring now to FIGS. 2 and 5, an upper guide member 40, which also extends axially of the shaft 16, is provided for guiding the arrow A which moves when fired. The upper guide 40, in one embodiment, comprises an inverted substantially U-shaped member having a base 41, a pair of lower depending sides 42, 43 extending along the opposite edges of the base 41 and a pair of upper extending sides 42*u*, 43*u*. As best illustrated in FIG. 5, in one embodiment, the two upper extending sides 42*u*, 43*u* are preferably angled such that they form a track or channel 41*c* capable of retaining slidable elements such as sights or scopes (see FIG. 14). It should be understood that the configuration of the upper portion of the upper guide 40 can vary extensively without departing from the spirit of this invention. For example, but not limited to, the upper extending sides 42*u*, 43*u* can be configured to form a channel 41*c* which is substantially circular, square or rectangular, the sides of the channel 41*c* can form a double groove or multiple grooves, it can be configured similar to the lower depending sides 44*a*, 44*b*, or it can even be configured such that some type of dovetail groove is on the outside of the upper extending sides 42*u*, 43*u*. One of the primary improvements regarding the upper guide 40 is to retain a guide insert 45 on the underside of the upper guide 40 (see generally FIG. 5) while forming a method of slidably retaining elements such as sights or scopes on the top side of the upper guide 40 (see generally FIGS. 5, 14, 15, 15A and 15B). It is foreseeable, and therefore should also be appreciated by those skilled in the art, that the lower depending sides 44*a*, 44*b* can be similarly configured to the upper extending sides 42*u*, 43*u* in order to retain any configuration of an upper guide insert 45. The track or channel 41*c* forms a substantially longitudinal channel that extends substantially the length of the main frame F. Two centrally depending projections 44*a*, 44*b* extend longitudinally along the base 41 and are positioned above and between the inclined guide surfaces 20*f*, 21*f* (FIG. 5). The two centrally depending projections 44*a*, 44*b* preferably have substantially "L" shaped mirror-image cross-sections. An upper guide insert 45, having a substantially "T" shaped cross section and which extends longitudinally along the base 41, is attached within the two centrally depending projections 44*a*, 44*b*. It should be understood that the upper guide can be attached in a large variety of methods including, but not limited to, screws, glueing/bonding, dovetail or other groove configurations. It should further be understood that the cross section of the upper guide insert 45 could vary from the "T" cross section particularly if the method of attachment differs or if the configuration of the lower depending sides 44*a*, 44*b* vary as described herein above. It should also be noted that if the arrow head 17 is comprised of a four-blade head, the upper guide insert 45 should be shortened such that the insert 45 does not extend forward so as to cover the recesses 64, 65 which are provided near the forward end of the arrow clip K side walls 50, 51 (see FIG. 8 and the description herein below). Therefore, the upper guide insert 45 could also be a two-piece insert such as to facilitate the ability to uncover the above described recesses 64, 65, as well as uncover previously described relieved portion 15*a* whenever a four-blade arrow is used or if some other arrowhead 17 configuration is used which would be obstructed by a one-piece full length upper guide insert 45. The upper guide insert 45 preferably engages the shaft 16 of the arrow A retaining it on such surfaces when it is being fired or moved therealong by the bow string E. Preferably the upper guide insert 45 is of a material that possesses self lubricating qualities such as UHMW, TEFLON (tetrafluoroethylene fluorocarbon polymer—TEFLON is a registered trademark of DuPont du Nemours, E.I. & Co.), other polymer compounds, other rigid materials, or the like whereby such material preferably decreases the friction between the upper guide insert and the arrow shaft 16. This decrease in friction preferably provides for a faster and more accurate movement of the arrow shaft 16 through the crossbow barrel or firing chamber thus preferably providing for a faster and more accurate arrow A or projectile after being launched from the crossbow C. It should be appreciated that the upper guide insert 45 will allow for an increased velocity of the arrow A upon firing due to the reduction of friction between the arrow shaft 16 and the guide insert 45. The additional coating of the gate members 20, 21, which serve as a bottom guide for the arrow A, will further reduce the overall frictional forces to preserve the increased velocity and firing accuracy. It should further be appreciated that since the present apparatus fully envelopes the arrow A in the firing chamber, i.e. the upper guide insert 45 and the closed gate members 20, 21, the cross bow can be accurately fired in substantially every position including upside down.

As best seen in FIG. 5, there are parallel longitudinally extending recesses 46, 47 formed between the central projections 44*a*, 44*b* and the depending sides 42, 43 which provide an unobstructed passageway for the upper feathers 18 on the arrow A as it is moved along the surfaces 20*f*, 21*f*. Similarly, the lower feather preferably passes through the slot or central opening 15 between the gates 20, 21 and in the main frame F.

As illustrated in FIG. 4, the rear end of the arrow shaft 16 is preferably provided with a pair of parallel faces 16*a*, 16*b* which are received in a suitable guide slot 55 (FIGS. 7 and 8) to orient the arrow A with two of the feathers 18 aligned in the openings 46, 47 and with the third feather 18 disposed in the central opening 15.

Figure 7:
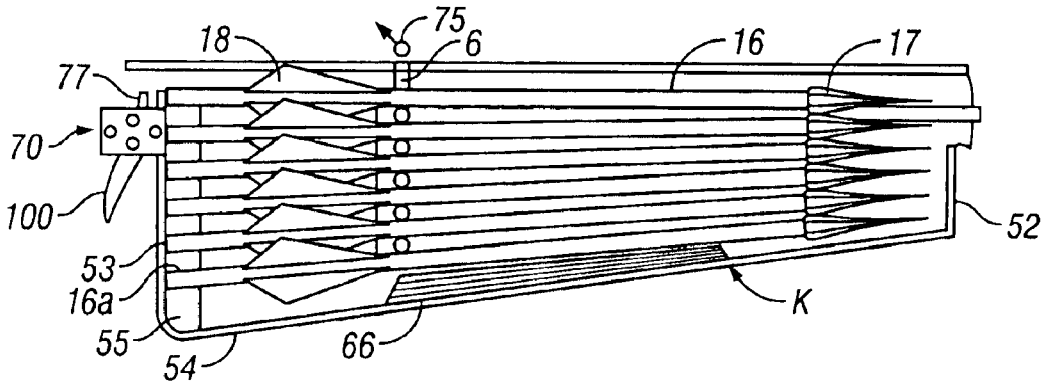
FIG. 7 is a sectional view illustrating the arrow clip.
Figure 8:
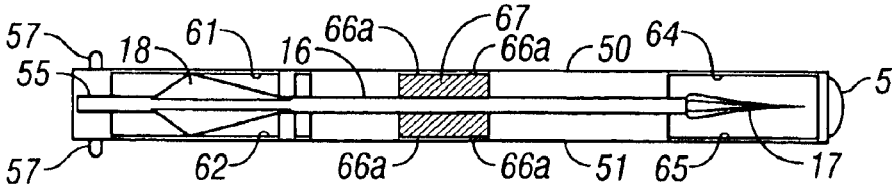
FIG. 8 is a transverse sectional view illustrating additional details of the arrow clip.

As illustrated in FIGS. 7 and 8, the clip K which contains a plurality of arrows A comprises a case having laterally spaced apart sides 50, 51 preferably joined together at the forward end by a front transverse member 52 and at the rear end by a rear transverse member 53 with an upwardly and forwardly inclined bottom 54. A vertically disposed groove 55 is preferably provided in the rear end portion 53 for receiving the substantially parallel faces 16*a*, 16*b* on the arrow shaft 16 (see FIG. 4) and to serve as a guide for orienting such arrows A with the upper feathers 18 aligned with the spaces 46, 47 formed between the central projections 44*a*, 44*b* and the depending sides 42, 43 (see FIG. 5), and the lower feather 18 aligned with the central opening 15 (FIG. 3).

Figure 13:
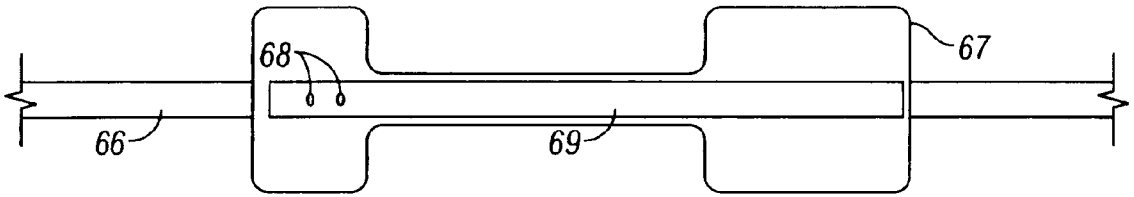
FIG. 13 is a top view illustrating the spring plate and the bow spring used in the clip.
Figure 13A:
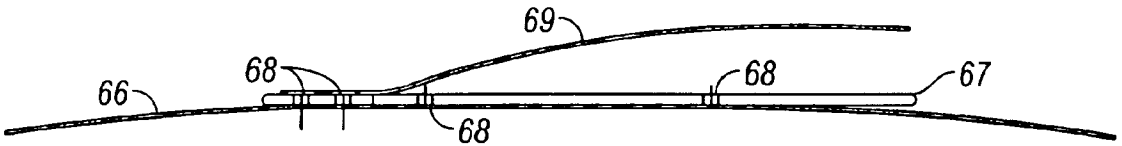
FIG. 13A side view of FIG. 13.

As illustrated, the spaced apart walls 50, 51 provide a central recess 60 (FIG. 5) for receiving the arrow shafts 16. Recesses 61, 62 are provided near the rear of the walls 50, 51 to accommodate the feathers 18 on the arrow shaft 16 so as to enable such arrows to be stored in the clip K without the feathers 18 being bent or crushed and to also facilitate movement of the arrows A vertically as they are discharged from the clip K as will be described hereinafter. Also, recesses 64, 65 are preferably provided near the forward end of the walls 50, 51 to provide space for the arrow heads 17. As best seen in FIG. 7, a suitable spring 66 is secured to the bottom 54, of the clip K, for urging the arrows A vertically so as to move them from the clip K into the main frame F. The improved spring 66 is preferably attached to the spring plate 67. The method of attaching the spring 66 to the spring plate 67 is preferably by screws 68. However, it should be appreciated that any variety of attachment methods such as welding, tack or spot welding, rivets, bolt and nut, glueing, and the like can be used. The spring plate 67 is preferably of a substantially "H" shaped configuration with a bow strip 69 disposed longitudinally or substantially parallel to the arrow shaft 16 along the upper side of the "H" shaped configuration (See FIGS. 13 and 13A). The bow strip 69 is substantially restrained when more than one arrow A is in the magazine K. When the final arrow A is ready for loading into the firing chamber, the bow strip 69 preferably becomes unrestrained and is configured to spring upwardly with a substantially convex surface then pushing on the arrow shaft 16. This upwardly convex surface urges the final arrow A into the firing chamber. As illustrated in FIG. 8, pins 66*a* are preferably inserted in the clip K to prevent the spring plate 67, and thus the spring 66, from being inadvertently dislodged from the clip K, particularly when clip K is empty and is removed for reloading. It should be appreciated that the spring retaining pins 66*a* can be any type of retention device such as buttons, button latches, crimped edges, and the like.

As further illustrated in FIG. 7, the feathers 18 are further protected from damage, such a collapse or disfigurement, especially during storage preferably by the inclusion of a spacer ball 75 between each of the arrow shafts 16. The spacer ball 75 is preferably metallic but can be any material which can resist deformation by the arrow shaft 16. Such materials could include, but are not limited to, plastic, polymer, methyl acrylate, or rubber. It should be appreciated that the ball 75 can also be a variety of shapes including but not limited to a pill, a box, a plug, any tapered pins or plugs, and the like. The ball 75 maintains a substantially vertical space between the arrows A being stored in the clip K. When the arrow A is being loaded from the clip K into the firing chamber, as is described herein, the ball 75 is preferably expelled through a hole 6 which preferably passes through the upper track 40 (see FIG. 2) and the upper guide insert 45 (see FIG. 5).

Referring again to FIG. 8, the clip K is preferably secured to the main frame F by the insertion of the tongue 5 into a corresponding groove in the forward portion of the main frame F as to some extent illustrated in FIG. 1. Further, button latches 57, located to the rear of the clip K (FIG. 8) engage the main frame F. Thus, the clip K is preferably snapped into place and securably attached to the main frame F until manually removed. It should be apparent to those skilled in the art that this attachment can be varied without departing from the spirit of the invention by using other available fastening means such as pins, grooves or notches in the frame, quick connects, and the like.

Figure 10:
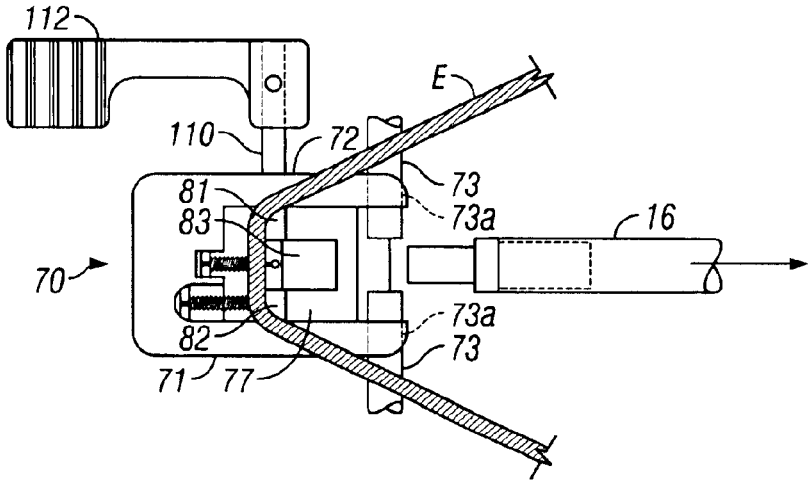
FIG. 10 is a view illustrating the bow string release mechanism.
Figure 11:
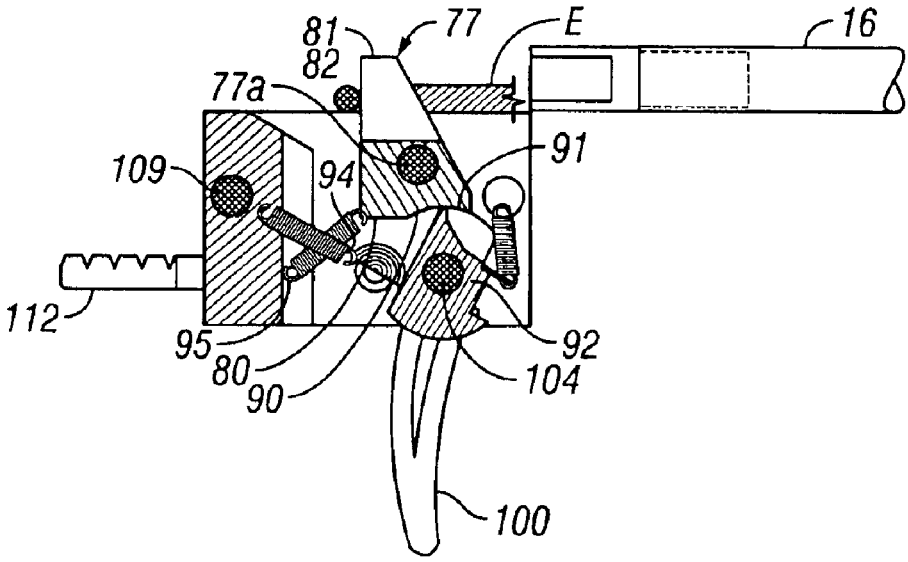
FIG. 11 is a side elevation partly in section illustrating the bow string release apparatus with the trigger in the cocked position.
Figure 12:
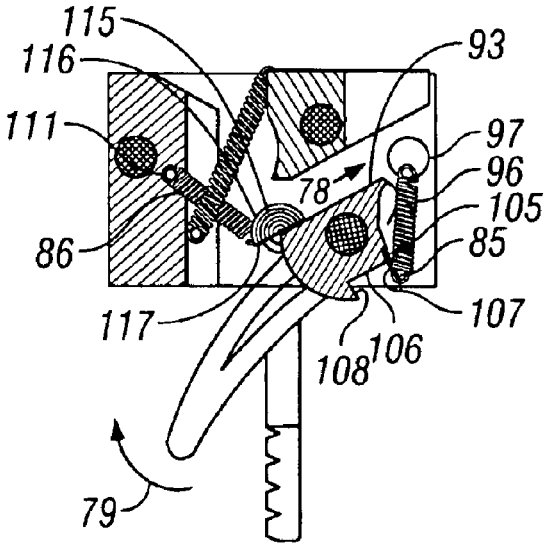
FIG. 12 is a side elevation partly in section illustrating the bow string release apparatus with the trigger in the firing position.

As illustrated in FIGS. 10–12, an improved firing mechanism 70 has a substantially "U" shaped cavity in the front end. The mechanism 70 preferably has three closed sides with the front, top, and bottom sides open. The two lateral sides 71, 72 preferably have a pair of pins 73 inserted through suitable holes 73*a* in the two lateral sides 71, 72. The pins 73 preferably act as a string release stop pin to prevent damage or overtravel of the latch 77. It should be appreciated that the stop pins 73 can be a single pin or two pins as described herein. It should further be appreciated that the material of the pins can also vary and is not intended to be limited to a metallic material. The firing mechanism 70 preferably slidably fits, at least partially, into the pistol grip P. This allows for greater ease in handling the cross bow for firing. The slidable fit of the firing mechanism within the pistol grip provides for fast installation and assembly or disassembly. The slidable fit can be accomplished through the use of grooved, dove-tailed, or similar channels and is preferably provided with a quick lock feature such as retractable pins, screws, thumb screws, latches, buttons, or the like.

A bow string latch 77 is positioned between the two lateral sides 71, 72 and is pivotally mounted on a pin 77*a* extending through suitable openings in the two lateral sides 71, 72. The bow string latch 77, which is illustrated in FIGS. 10 and 11, preferably comprises a body having a pair of laterally spaced upstanding projections 81, 82 with a groove 83 therebetween for receiving the bow string E. When the string E is released by pivoting the latch 77 forwardly, string E engages the rear end of the arrow shaft 16 and drives such shaft forward to fire it. It should be appreciated that in order to preferably have precise and accurate firing of the arrow A, the upstanding protrusions 81, 82 of the latch 77 should be substantially smooth. Preferably, the smooth surface will substantially remain in contact with the string as the string is released and moves in a substantially longitudinal and frontward direction. Preferably, this contact will prevent the string from jumping or moving in a non-longitudinal direction which could prevent a true center line firing.

As illustrated in FIGS. 11 and 12, the bottom 80 of the bow string latch 77 is provided with a concave cam surface 90 which is of substantially the same radius as the cylindrically shaped cam surface 91 on the cylindrical trigger support 92. A return spring 94 connects the bottom of the bow string latch body 77 with a pin or rod 95 that is carried in the rear of two lateral sides 71 and 72 and extends transversely therebetween.

The trigger 100 is illustrated in FIGS. 11 and 12. The trigger 100 is preferably integral with the cylindrical trigger support 92. It must be appreciated that the trigger 100 and the cylindrical trigger support 92 can be separate pieces attached by a suitable means. The trigger 100 is rotatably mounted on a transversely extending pin or rod 104 that is also mounted in suitable openings in the two lateral sides 71 and 72. The front portion of the cylindrical trigger support 92 is provided with a transversely extending groove designated generally 105 that has a base 106 and a pair of parallel sides 107 and 108. A spring 96 is preferably attached between a hole 85 in one of the parallel faces 107 of the groove 105 in the cylindrical trigger support 92 and the string release stop pin 97 to provide for returning the trigger 100 and the cylindrical trigger support 92 to its original pre-firing position. It should be appreciated the attachment of the spring 96 in a hole 85 is a preferred embodiment; however, a varied place of attachment to the cylindrical trigger support 92 is still within the spirit of the present improvement.

The cylindrical trigger support 92 is preferably relieved on the opposite side from the groove 105. The cylinder is cutaway or relieved so as to permit the bow string latch 77 to pivot forward and release the bow string E when the trigger support cylinder 92 is rotated in the direction of arrow 78 from the position illustrated in FIG. 11 to the position illustrated in FIG. 12 of the drawings.

As illustrated in FIGS. 10–12, the improved firing mechanism 70 is preferably more efficient and smaller. The compact firing mechanism 70 preferably allows closer proximity between the string E and the arrow A thus preferably providing a more positive strike action, when the string E is released. The firing mechanism 70 is preferably retained in the main frame F by the housing mounting pin 109. It should be appreciated that the firing mechanism 70 can be retained in the main frame K in any suitable manner including, but not limited, to screws, set screws, bolts, various pins, and the like. It should further be appreciated that the firing mechanism 70 could be more permanently attached within the main frame F if desired. The firing mechanism 70 preferably includes a trigger safety latch 112 which is connected to a shaft 110 carried in the two lateral sides 71, 72. The safety latch 112 includes a half cylinder 115 which is rotatably mounted between the two lateral sides 71, 72 on the shaft 110. The half cylinder 115 has a convex curved surface 116 which terminates in a plane surface 117. The safety 112 locks the trigger support cylinder 92 against rotation in the direction of arrow 78 as long as the convex curved surface 116 engages the plane surface 93 on the back of the trigger support cylinder 92. As the shaft 110 is rotated, the half cylinder 115 preferably turns from the position illustrated in FIG. 11 to the position illustrated in FIG. 12, and the curved surface 116 on the half cylinder safety block 115 is moved out of contact with the plane surface 93 on the back of the trigger support cylinder 92, thereby permitting such trigger to be rotated rearwardly as indicated by the arrow 79. Such movement of the trigger preferably rotates the trigger support cylinder in the direction of arrow 78 and the convex cam 91 is moved out of engagement with the concave cam 90 on the base of the bow string release block 77, freeing such block to rotate or pivot forwardly to thereby release the bow string E so as to fire the arrow A from the cross-bow C. A spring 86 preferably connected between the half cylinder safety block 115 and a pin 111 on the rear side of the firing mechanism 70 is preferably biased to return the half cylinder 115 to the position illustrated in FIG. 11.

Figure 14:
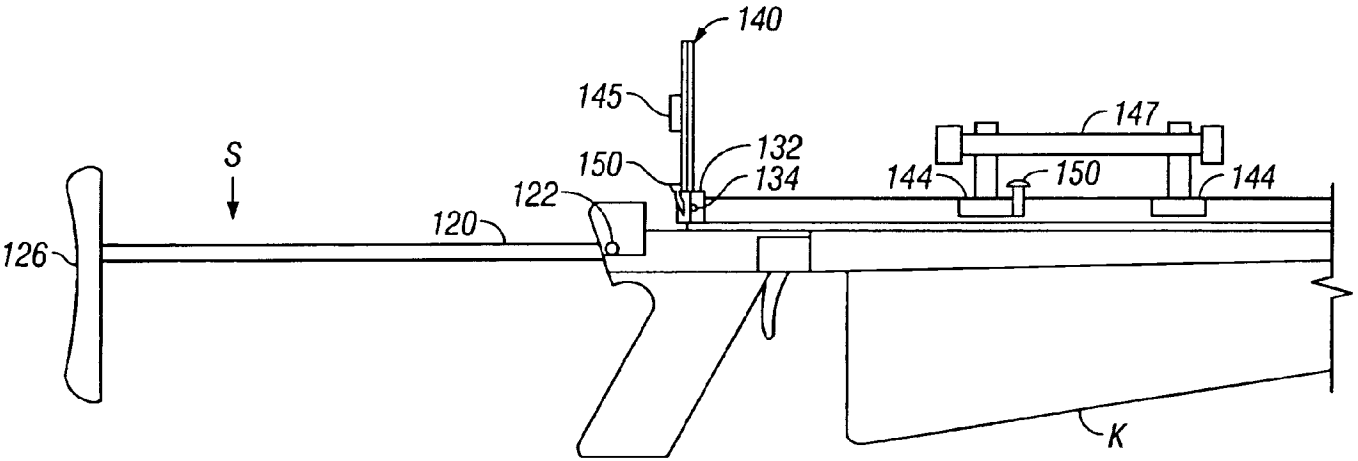
FIG. 14 is a side elevation partly in section illustrating the retractable shoulder stock in an extended position with the aiming sight elevated for use.

FIG. 14 shows the improved shoulder rest or stock portion S of the cross-bow C in extended position for firing. The shoulder support or shoulder stock S comprises a pair of laterally spaced arms 120 which are preferably slidably mounted at the rear of the main frame F. The substantially longitudinal extension of the arms 120 can preferably be releasably adjusted in a multitude of positions providing a variety of lengths between a substantially fully extended position and a substantially fully retracted position. The intermediate longitudinal positions can be releasably fixed through a pair of adjustment screws 122, through a series of notches or grooves disposed along the length of the arms 120 and corresponding receiving notches or grooves at the rear of the main frame F., or with an adjusting slot preferably cut substantially the length of the arms 120. The outer ends of the arms 120 are preferably fixedly attached by the pad or shoulder rest 126. It should be appreciated that although a variety of attachment methods are available, the preferred method of attachment is screws or other fasteners that can be relatively easily detached for cleaning, compact storage, and transportation of the apparatus.

Figure 9:
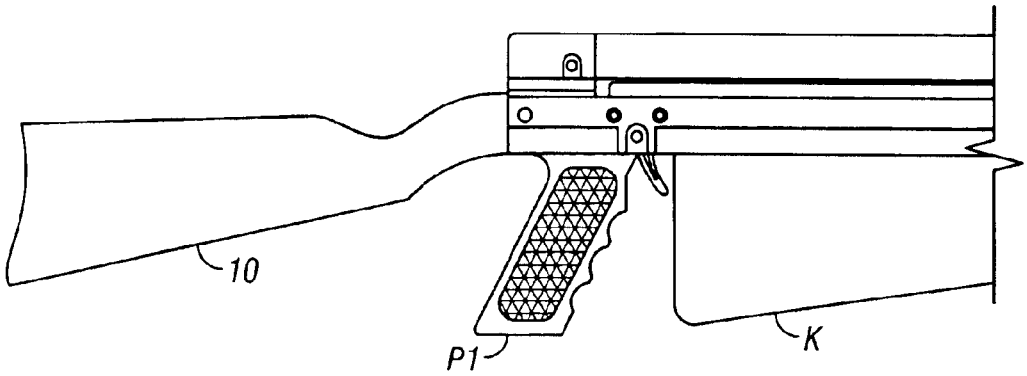
FIG. 9 is a view illustrating an embodiment with a rifle stock.

In another embodiment, a rifle stock 10 can be attached to the rear of the main frame F (FIG. 9). In this embodiment, the extendible stock S can either be removed or it can remain in its retracted position. As illustrated, the rifle stock is integral with the pistol grip P1 and therefore is releasably attached in place of the pistol grip P.

An adjustable peep sight 140 (FIGS. 14, 15, 15A, and 15B) is preferably provided on the cross bow C. The peep sight 140 preferably includes a sub base 130 which is "U" shaped to protect the peep sight 140 when it is in the lowered or closed position. The peep sight 140 further comprises a base portion 132 which is mounted on a pivot pin 134, and includes a pair of upstanding arms 136, 137 which are preferably spaced laterally apart and attached together at their lower ends at the base 132 and their upper ends by transverse member 138. A substantially longitudinally extending slot 139 is thus formed between the upstanding arms 136 and 137 for receiving a movable sight member 145. The movable sight member 145 may be moved upwardly or downwardly on the upstanding arms 136, 137.

The improved adjustable peep sight sub base 130 is slidably attached between the upper extending sides 42*u*, 43*u*. Thus, allowing for the adjustable peep sight assembly to be moved longitudinally along the upper guide member 40 through the channel 41*c* formed between the upper extending sides 42*u*, 43*u*. It should be appreciated that the rear adjustable peep sight can be removed when using a scope, described further herein below, or can remain attached to the upper guide 40 but in its lowered position.

Figure 15:
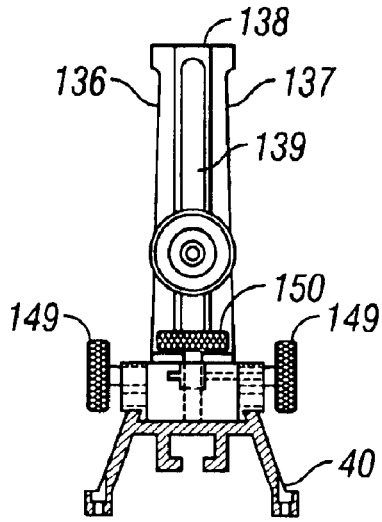
FIG. 15 is a front view illustrating additional details of the slidable base of the elevated sight.
Figure 15A:
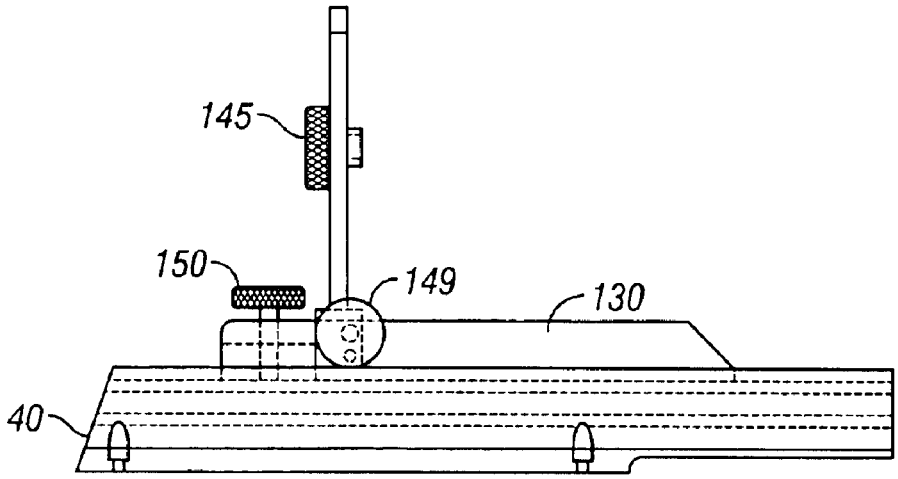
FIG. 15A is a side view illustrating additional details of the slidable base of the elevated sight.
Figure 15B:
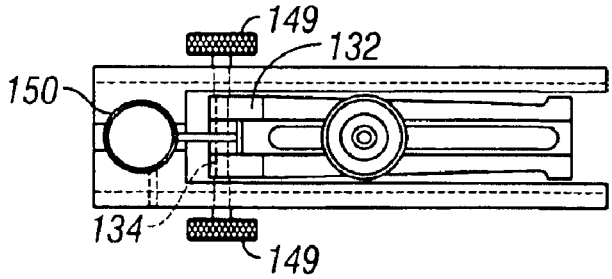
FIG. 15B is a top view illustrating additional details of the slidable base of the elevated sight.

When the rear adjustable peep sight 140 is used, preferably lock screws 149 are mounted in the sub base 130 on opposite sides of the upper extending sides 42*u*, 43*u* so as to engage the base block 132 and lock it in a desired position. It should be appreciated that the lock screws 149 are positioned such as to provide alternate positions of affixing the rear peep sight 140. A preferred method of such attachment is for the lock screws 150 to thread through the sub base block 130 into the substantially longitudinal channel 41*c*. Alternative attachment methods can include, but are not limited to, having a substantially longitudinal slot in the upper extending sides 42*u*, 43*u*, several threaded holes on each of the upper extending sides 42*u*, 43*u*, or various other methods of adjustable positioning. A spring is connected to the pivotally mounted base block 132 for swinging the arms 136, 137 into a vertically upright position as illustrated in FIGS. 14, 15, and 15A. The lock screws 149 may then be tightened to hold the peep sight in its erect position for firing. When it is desired to retract the peep sight, the lock screws 149 may be loosened and the peep sight lowered and thereafter the lock screws 149 may again be tightened to lock the peep sight in its retracted position. The lock screws are also preferably used to adjust the windage from right to left and vice versa.

The improved upper guide member 40 also provides for the attachment of a scope 147. The scope 147 can comprise a quick locking scope mount with a completely adjustable eye relief. As illustrated in FIG. 14, the scope 147 is removably attached to a base 144. As with the improved adjustable rear peep sight 140, the scope base 144 is slidably mounted within upper extending sides 42*u*, 43*u*. The scope bases 144 are preferably attached in the manner described for the rear peep sight sub base 130 described herein above. A front peep sight 8 (FIG. 1) is similarly mounted at the front of the upper guide 40 and is also removable and slidable along the channel 41*c* formed on the top of the upper guide 40. As previously described herein above, the various configurations of the channel 41*c* can be adapted to a variety of front sights. Therefore, it should be appreciated that the selection of different front or rear sights or scopes will not depart from the spirit of this invention. It should be further appreciated that any sights, scopes, and the like can be attached with a quick locking mechanism to facilitate quick attachment and removal.

The bow limbs B are preferably pivotally mounted near the forward end of the main frame F to permit the bow limbs B to be pivoted from the retracted position as illustrated in FIG. 3 of the drawing outwardly into the extended position illustrated in FIG. 2 for firing. The string E is preferably attached such that when in the cocked position, the string E substantially extends in the same plane that passes through the center of the bow limbs B when they are in the extended position; such plane is substantially parallel to the main frame F.

Figure 6:
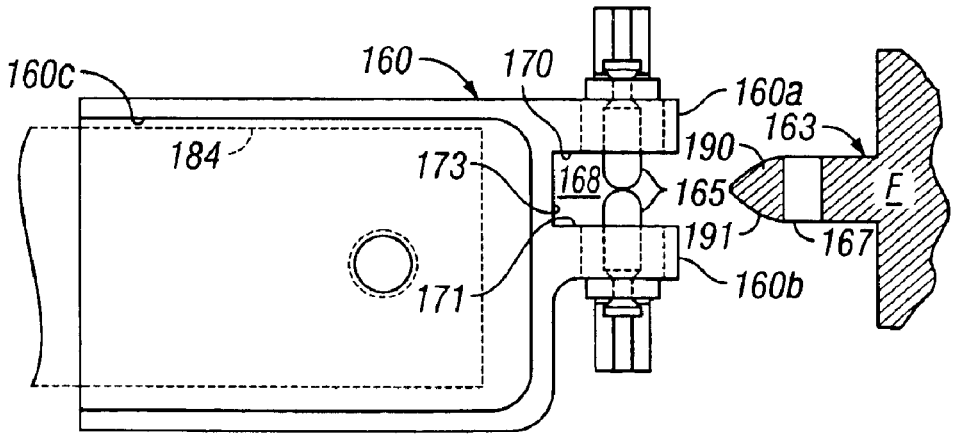
FIG. 6 is a view illustrating the mounting of the bow limbs on the main frame of the cross-bow.
Figure 6A:
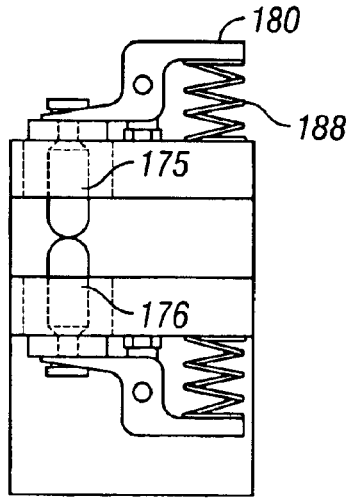
FIG. 6A is a side view of FIG. 6 illustrating further details of the mounting of the bow limbs on the main frame of the cross-how.

As illustrated in FIGS. 2, 6, and 6A, the bow limbs B are attached to mounting blocks 160 which are pivotally connected by pivot pins 162 to the connecting blocks or the pivot blocks 163 that are integrally formed near the forward end of the main frame F. It is understood that the pivot blocks 163 can also be separate from the main frame F and attached to the main frame F by screws (not shown) or other suitable fasteners. Spring loaded latching pins 165 are carried on the bow blocks 160 and are adapted to be inserted into the openings 167 in the pivot blocks 163 when aligned therewith.

As illustrated in FIGS. 6 and 6A, the bow block 160 is preferably provided with a pair of laterally projecting plates 160*a*, 160*b*. The plates 160*a*, 160*b* form an opening 168 between them and can be parallel to each other although in a preferred embodiment they are preferably angled inwardly toward each other. The angled opening preferably comprises inclined surfaces 170, 171 provided on opposite sides of a base 173 disposed at the bottom or back of the opening. Suitable openings 175, 176 are provided through the plates 160*a*, 160*b*, for receiving the latching pins 165. Preferably there will be at least one latching pin 165 passing through each of the openings 175, 176 on each of the bow blocks 160. Each of the pins 165 is connected to a spring loaded thumb latch 180 which can be depressed causing the pins 165 to disengage. Springs 188 urge the thumb latch 180 to push the latching pins 165 through the openings 175, 176 in the laterally projecting plates 160*a*, 160*b*.

The connecting block or pivot block 163 is preferably provided with a converging tapered or inclined surfaces 190, 191 which form a wedge-like portion that is adapted to be received between the laterally projecting plates 160*a*, 160*b* of the pivot blocks 160. An opening 167 is provided in the wedge-shaped portion of the connecting block or pivot block 163 and extends through to the inclined surfaces 190, 191 and is provided for receiving the ends of the latching pins 165 that are slidably mounted in the laterally spaced openings 175, 176 on opposite sides of the laterally projecting plates 160*a*, 160*b*.

If desired the bow blocks 160 may be swung in position and the wedge shaped surfaces 190 and 191 will engage the pins 165 to force them laterally apart and permit the bow block 160 to be pivoted over the connecting block or pivot block 163. When the pins 165 become aligned with the openings 167 in the wedge shaped portion of the connecting or pivot block 163, the pins 165 will move laterally to engage the openings 167 and thus lock or latch the ends of the bow in the extended position such as is illustrated in FIG. 2.

In order to release the latching members and permit the bow block 160 to be swung back to the retracted position such as illustrated in FIG. 3, the thumb latch 180 is depressed causing the pins 165 to withdraw from the openings 167 in the pivot blocks 163. When the bow limbs B and the bow block 160 are completely retracted, they will be held in the retracted position preferably by a small ball latch or button latch 192. It should be appreciated that the function of such a ball latch or button latch 192 is to merely keep the bow limbs B from extending while the cross bow is being transported or handled. However, preferably any latch which retains the bow limbs B in the retracted position must be easily overcome when moving the bow limbs into the firing position (FIG. 2).

It will be appreciated, by those in the art, that the quick connect type of latching mechanism provided with the pins 165 acting against the inclined surfaces 190 and 191 will facilitate stringing the bows or bow limbs B as it will be necessary to only momentarily position the pins 165 opposite the holes 167 to enable the spring loaded pins 165 to be moved laterally into such openings 167 and thereby locking the bow limbs B in their open or extended position suitable for firing.

In another embodiment, bow blocks 160 are adapted to attachably receive a bow limb adaptor plate 184. This adaptor plate 184, is preferably fixedly attached to an alternative set of bow limbs. In this manner, various weights of bow limbs can be interchanged to provide a greater variety of performance and utility. Thus, lower weight bow limbs can be attached to the improved crossbow C when sufficient power is not available to cock a string attached to heavier weight bow limbs or when different weight limbs are desired for different types of shooting such as target shooting or hunting. Thus, the improved bow hinge latch mechanism is more efficient in that the bow blocks 160 are preferably able to receive substantially any two-piece take down bow through the utilization of the adaptor plate 184.

Preferably, as illustrated in FIGS. 1 and 3, a detachable and pivotable stirrup 200 is provided to be releasably and pivotably attached at either the forward end or the rearward end of the main frame F. The stirrup can facilitate carrying the cross bow C, facilitate loading or cocking the bow, and stringing the bow string E. Preferably, the stirrup 200 is attached to the rearward end of the main frame F when it is desired to swing the bow limbs B into the extended position.

In this position, the archer may place one foot in the stirrup 200 to facilitate forcing the bow limbs B in position in their respective bow hinge latch mechanisms to thereby string the bow B. It will be appreciated that the ends of the bow strings E will be affixed to the opposite ends of the bow limbs B prior to the pivotally mounted bow limb hinges being swung into the open or extended position to draw such bow strings taut.

Preferably, when cocking the cross bow C, the stirrup 200 is attached to the forward end of the main frame F. Preferably, the archer may then place one foot in the stirrup 200 at the front end of the main frame and thereby free both hands for use in drawing the bow string E taut and latching it in the trigger mechanism 70 for firing.

In either the forward or rearward position, the stirrup 200 is mounted on a pivot pin 201 which extends transversely of the front and rear ends of the main frame F. With the stirrup 200 attached at either the front end or the rear end, the bow may be carried by simply manually gripping the cross piece of the stirrup 200. Preferably, the bow limbs B are in the collapsed position, as illustrated in FIG. 3 when the device is carried by the stirrup. It should be appreciated that although the embodiment describes an interchangeable stirrup 200, the improved cross bow can be provided with two stirrups, one at each the forward end and the rearward end with one or both stirrups 200 releasably attached or with one or both stirrups 200 more permanently attached.

In use the bow limbs B may be secured in suitable openings 160*c* in the bow blocks 160 and the bow string E secured to the opposite ends of such bow limbs. Thereafter, the bow limbs B may be pivoted from the retracted position illustrated in FIG. 3 to the extended position illustrated in FIG. 2 to thereby draw the bow string E taut and place the bow limbs B in the position for firing of a cross-bow C. It will be further appreciated that when the bow blocks 160 have been moved to the extended position the locking pins 165 carried therein will be lodged in the openings 167 of the connecting or pivot blocks 163 to thereby securely lock the bow limbs B in their extended position.

With the clip K latched in position in the main frame F and the arrows A stored in the clip K in position under the jaws 20, 21, the cross-bow is ready for loading and cocking. When the bow string E is drawn back past the firing mechanism 70, the bow string E preferably engages and pushes back the upstanding pins 20*e*, 21*e* to spread apart the gates or jaws 20, 21 to thereby permit the uppermost arrow A, in the clip K to be urged upwardly by the spring 66 until the arrow engages the upper guide insert 45 that is disposed above the central opening 15 through which such arrow passes. When the bow string E is set against the latch 77, the jaws 20, 21 will be closed by springs 20*g*, 21*g* and the upper rounded surfaces will thereafter support the arrow shaft 16 in the firing chamber in position for firing. After the safety release 112 has been moved to position for firing, the trigger 100 can be actuated to fire the arrow, and after firing the arrow A, the cross-bow is then ready for the reloading of the next arrow in the clip K. When the bow string E is pulled back to cock the bow and is drawn back past the firing mechanism 70 and engages and pushes back the upstanding pins 20*e*, 21*e* to spread apart the gates or jaws 20, 21, and releasably mounted on the latch 77, the gates 20, 21 will again be opened to permit the next uppermost arrow A to be moved upwardly through the opening 15 in the main frame F and to preferably position arrow A in the firing chamber for firing. Thereafter, firing may be repeated until the supply of arrows in the clip K has been depleted. When the last arrow A is ready to be moved through the main frame F opening 15 and into the firing chamber, bow strip 69 (FIGS. 13 and 13A) will urge the final arrow A into firing chamber.

The foregoing disclosures and descriptions of the apparatus disclosed herein are illustrative and explanatory thereof, and various changes in the size, shape, and materials as well as in the details of the illustrated construction may be made without departing from the spirit of the invention.

What is claimed is:

1. An automatic loading cross bow comprising:

a main frame having a front end and a rear end;

at least two bow limbs mounted on said main frame for firing arrows therefrom along a firing axis;

a clip releasably attached to said main frame for storing a plurality of arrows therein;

a spring plate disposed in said clip for discharging arrows thereon;

a pair of laterally spaced jaws slidably mounted on said main frame wherein said jaws open when the cross bow is cocked to permit an arrow to be urged by said spring plate from storage in said clip into a firing position, in which said arrow is supported by said spaced jaws;

first releasably attached stirrup; and a retractable stock slidably attached into the rear end of said main frame.

2. The cross bow of claim 1, wherein said plurality of arrows further comprises at least one hunting arrow having at least two blades.

3. The cross bow of claim 1, wherein said plurality of arrows further comprises at least one hunting arrow with more than two blades.

4. The cross bow of claim 1, wherein said plurality of arrows further comprises hunting arrows and target arrows.

5. The cross bow of claim 1, wherein at least one spacer is inserted between each of the said plurality of arrows.

6. The cross bow of claim 5, wherein said at least one spacer is a metallic.

7. The cross bow of claim 5, wherein said at least one spacer is a non-metallic.

8. The cross bow of claim 5, wherein said at least one spacer is ejected through an upper guide when said cross bow is being cocked.

9. The cross bow in claim 1, wherein the said spaced jaws are coated with a non elastomeric coating.

10. The cross bow of claim 1, wherein said first stirrup is releasably and pivotably attached to the front end of said main frame and a second stirrup is releasably and pivotably attached to the rear end of said main frame.

11. The cross bow of claim 1, further comprising a pistol grip substantially encompassing a trigger mechanism, said pistol grip depending downward from said main frame.

12. The cross-bow of claim 11, wherein said pistol grip further comprises a rubber coating for gripping.

13. The cross bow of claim 1, wherein said cross bow can be rotated to any position when firing said arrows.

14. A cross bow comprising:

an upper guide track having an outside and an inside;

said upper guide track having a top side on said outside;

a slidably mounted rear peep sight; and a slidably mounted scope.

15. The cross bow of claim 14, wherein said upper guide track further comprises a track insert attached to said inside.

16. The cross bow of claim 15, wherein said track insert is of a non-elastomeric and non-metallic material and wherein said track insert guides said arrow when said arrow is fired.

17. An improved automatic cross bow comprising:

a main frame having a front end and a rear end;

an extendable stock retractably attached to said rear end;

at least two bow limbs mounted on said main frame for firing arrows therefrom along a firing axis, wherein said at least two bow limbs are of a specified bow weight and wherein said at least two bow limbs are interchangeable with bow limbs of a different specified bow weight;

an upper guide track having an outside and an inside, wherein said upper guide having a top side on said outside and wherein a removable slidably mounted rear peep sight is slidably attached on said top side, and further wherein a removable slidably mounted scope is slidably mounted on said top side; and a clip releasably attached to said main frame for storing a plurality of arrows therein, wherein a spring plate is disposed in said clip for discharging arrows thereon, and wherein a pair of laterally spaced jaws slidably mounted on said main frame open when the cross bow is cocked to permit one of said plurality of arrows to be urged by said spring plate from storage in said clip into a firing position, wherein said arrow is supported by said spaced jaws.

* * * * *